US006415118B1

(12) United States Patent
Setoriyama et al.

(10) Patent No.: US 6,415,118 B1
(45) Date of Patent: Jul. 2, 2002

(54) IMAGE FORMING APPARATUS WITH INCLINED GUIDE FOR SHEET MATERIAL

(75) Inventors: Takeshi Setoriyama, Kashiwa; Yoji Tomoyuki, Ichikawa; Susumu Ikuma, Tokyo; Hidenobu Suzuki, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,308

(22) Filed: Sep. 21, 2000

(30) Foreign Application Priority Data

| | | |
|---|---|---|
| Sep. 28, 1999 | (JP) | 11-273611 |
| Oct. 5, 1999 | (JP) | 11-284047 |
| Oct. 5, 1999 | (JP) | 11-284239 |

(51) Int. Cl.[7] ..... G03G 21/20
(52) U.S. Cl. ..... 399/92; 347/170; 399/107
(58) Field of Search ..... 399/75, 92, 93, 399/107, 124, 316, 400; 347/170

(56) References Cited

U.S. PATENT DOCUMENTS

| | | | | |
|---|---|---|---|---|
| 4,974,033 A | * | 11/1990 | Yamada et al. | 399/124 |
| 4,992,834 A | | 2/1991 | Yamamoto et al. | 355/299 |
| 5,045,892 A | * | 9/1991 | Morisawa et al. | 399/400 |
| 5,105,208 A | * | 4/1992 | Matsuoka et al. | 399/75 X |
| 5,479,242 A | * | 12/1995 | Sato et al. | 399/92 |
| 5,528,342 A | * | 6/1996 | Setoriyama et al. | 399/107 |
| 5,537,191 A | | 7/1996 | Aruga et al. | 355/245 |
| 5,570,159 A | * | 10/1996 | Hirose et al. | 399/107 |
| 5,749,035 A | * | 5/1998 | Ban et al. | 399/316 |
| 5,787,321 A | * | 7/1998 | Nishikawa et al. | 399/92 X |
| 5,887,226 A | * | 3/1999 | Taki | 399/92 |
| 5,907,745 A | * | 5/1999 | Azuma et al. | 399/92 |
| 6,084,622 A | * | 7/2000 | Sugiura et al. | 347/170 |

FOREIGN PATENT DOCUMENTS

| | | | |
|---|---|---|---|
| EP | 0 549 089 A | 6/1993 | |
| EP | 0 574 041 | 12/1993 | G03G/15/00 |
| EP | 0 632 339 A | 1/1995 | |
| EP | 0 656 570 A | 6/1995 | |

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

The invention provides an image forming apparatus having sheet supply device, image forming device for forming an image on a sheet supplied by the sheet supply device, fixing device for fixing the image formed on the sheet, a sheet guide for guiding the movement of the sheet, and a control board bearing an element for controlling the image forming device, wherein the sheet guide positioned between the sheet supply device and the fixing device is provided substantially linearly in such a manner that the sheet moves in an inclined upward direction, and the control board is provided in a space under the sheet guide and at the bottom face of the apparatus.

26 Claims, 12 Drawing Sheets

IMAGE FORMING APPARATUS WITH INCLINED GUIDE FOR SHEET MATERIAL

BACKGROUND OF THE INVENTION

1. Field of the Invention

The present invention relates to an image forming apparatus for forming an image on a sheet, such as a copying machine, a printer or a facsimile apparatus.

2. Related Background Art

In the field of image forming apparatus such as a copying machine, a printer or a facsimile apparatus, there have been proposed various configurations on the arrangement of a sheet cassette or a sheet tray for containing and supporting sheets for image formation, image forming means for forming an image on a sheet, fixing means for semi-permanently fixing an image transferred onto a sheet, and control means for controlling the operation of the apparatus and the image forming process. The following explanation will be given on a laser beam printer (hereinafter simply represented as printer) as an example.

The principal configuration of a conventional printer is shown in FIGS. 4 and 5.

A printer, constituting an image forming apparatus, is provided with a sheet supplying portion, including a sheet cassette 101 serving as sheet supporting means for supporting and containing sheets for image formation, and sheet supplying means 102 for feeding the sheet supported by the sheet cassette.

Also an image forming portion is composed of a process cartridge 103 integrally formed of a photosensitive drum 104 for image formation, a charger for uniformly charging the photosensitive drum, a developing device for forming a toner image on the photosensitive drum and a toner container, and a laser scanner 105 for writing image information by a light beam onto the photosensitive drum charged by the charger.

In a position opposed to the photosensitive drum across the conveying path of the sheet, there is provided a transfer charger 106 constituting transfer means for transferring the toner image, formed on the photosensitive drum, onto a sheet. Also in a downstream position of the transfer means, there are provided paired fixing rollers 107 serving as fixing means for semi-permanently fixing the toner image transferred onto the sheet, and the sheet on which the image is fixed by the paired fixing rollers is thereafter discharged onto a sheet discharge tray 108 provided outside the apparatus.

Such sequence of image forming operations onto the sheet is more or less same in any printer, but the features of the printer vary according to the arrangement of the sheet conveying path within the apparatus.

In the printer shown in FIG. 4, the above-described sheet conveying path is provided approximately horizontally in the apparatus. In FIG. 4, a sheet cassette 101 is provided in an inclined position, with respect to the horizontal plane, at the right-hand end portion of the apparatus, and sheet supplying means 102 is provided at an end portion of the sheet cassette. The sheet conveying plane is provided substantially horizontally toward paired fixing rollers 107, while image forming means such as a process cartridge 103 is provided above the conveying path and a transfer charger 106 is provided in an position opposed thereto. The sheet bearing the transferred image is discharged onto a sheet discharge tray 108 positioned approximately parallel to the sheet cassette 101.

Also a printer shown in FIG. 5 has a configuration obtained by rotating, by 90°, the image forming apparatus shown in FIG. 4. More specifically, in this type of the apparatus, the sheet cassette 101 and the sheet discharge tray 108 are provided substantially horizontally, and a sheet fed by the sheet supplying means 102 from the sheet cassette 101 at the lowermost part of the apparatus is conveyed in a substantially vertical direction, with respect to the horizontal plane, for performing image forming and fixing operations.

As explained in the foregoing, the sheet conveying path in the recent printers is often formed linearly and substantially horizontally or vertically from the sheet supply means 102 to the fixing means 107, and, in such configuration, the position of the fixing means 107 becomes a problem.

The fixing means 107 achieves fixation of the toner onto the sheet by fusing the toner deposited on the sheet, by heat generated by heating of the fixing roller and by a pressure generated at the nip of the paired rollers. Consequently the fixing means 107 generates a large amount of heat at the image formation, thereby elevating the temperature in the apparatus.

In the image forming apparatus of a type in which the sheet is conveyed substantially horizontally as shown in FIG. 4, the process cartridge 103 and the laser scanner 105 are positioned at the side of and above the fixing means 107 constituting the source of heat, so that the heat generated by the fixing means 107 may result in inconveniences such as fusion and solidification of the toner contained in the process cartridge 103 or a change in the refractive index of optical lenses provided in the laser scanner 105.

Also circuit boards of the control means 109, such as an electric supply portion or a driving portion for controlling the apparatus are to be provided in a space available substantially parallel to the sheet conveying path. Since such electric supply portion and driving portion also generate heat, there is required, in order that the process cartridge 103 and the laser scanner 105 are not affected by such generated heat, means for preventing the temperature increase in the apparatus as well as for dissipating the heat generated by the fixing means 107. This has been achieved by providing a plurality of heat insulating members for preventing the temperature increase in the apparatus or providing a fan for air cooling the interior of the apparatus, but such means results in an increase in the cost and dimension of the apparatus.

Also in the sheet supplying operation, the leading end of a sheet fed by the sheet supply means 102 reaches the image forming portion so that the image forming operation is started, before the trailing end of the sheet comes out of the sheet supply means 102. Therefore, when the trailing end of the sheet comes out of the sheet supply means 102, a vibration is generated in the sheet by a large diversion in the direction thereof, and such vibration is transmitted to the image forming portion to perturb the image formed on the sheet.

Also in the apparatus of a type in which the sheet is conveyed substantially vertically as shown in FIG. 5, the process cartridge 103 and the laser scanner 105 are relieved from the influence of heat since the fixing means 107 is provided in the uppermost position of the apparatus, but a higher precision is required for such conveying control and image forming operation because the sheet is conveyed substantially vertically against the force of gravity. Such higher precision has been achieved by providing sheet conveying guide members and paired conveying rollers in a number larger than in the apparatus in which the sheet is conveyed horizontally, but such measure results in an increase in cost and dimension of the apparatus.

Also the mounting angle of the laser scanner becomes larger than in the horizontally conveying type (cf. FIG. 4) to result in a larger load on the bearing of a scanner motor, whereby the bearing becomes deteriorated sooner to shorten the service life of the apparatus.

Also a large diversion in the direction of the sheet, as in the case of the type shown in FIG. 4, results in drawbacks such as vibration noise and a perturbation in the image.

In order to resolve the above-mentioned drawbacks, the apparatus has been so designed as to increase the dimension of the entire apparatus thereby separating the heat-generating fixing means from components susceptible to heat or as to adopt a layout allowing horizontal positioning of the laser scanner, but such measure does not lead to fundamental resolution of these drawbacks but results in other drawbacks such as an increase in dimension or manufacturing cost of the apparatus.

SUMMARY OF THE INVENTION

In consideration of the foregoing, an object of the present invention is to provide a compact image forming apparatus.

Another object of the present invention is to provide an image forming apparatus lighter in weight.

Still another object of the present invention is to provide an image forming apparatus excellent in sheet conveying ability.

Still another object of the present invention is to provide an image forming apparatus comprising:

sheet supply means;

image forming means for forming an image on a sheet fed by the sheet supply means;

fixing means for fixing the image formed on the sheet;

a sheet guide for guiding the movement of the sheet; and a control board bearing an element for controlling the image forming means;

wherein the sheet guide provided between the sheet supply means and the fixing means is positioned substantially linearly in such a manner that the sheet moves upward in an inclined direction, and the control board is provided in a space under the sheet guide and at the bottom face of the apparatus.

Still another object of the present invention is to provide an image forming apparatus comprising:

sheet supply means;

image forming means for forming an image on a sheet fed by the sheet supply means;

fixing means for fixing the image formed on the sheet;

a sheet guide for guiding the movement of the sheet; and a drive source for driving the sheet supply means and the fixing means;

wherein the sheet guide provided between the sheet supply means and the fixing means is positioned substantially linearly in such a manner that the sheet moves upward in an inclined direction, and the drive source is provided in a space under the sheet guide.

Still another object of the present invention is to provide an image forming apparatus comprising:

sheet supply means;

image forming means for forming an image on a sheet fed by the sheet supply means;

fixing means for fixing the image formed on the sheet, the fixing means being positioned in an upper part of the apparatus;

an air path for introducing the external air from a lower part of the apparatus and generating an air flow utilizing the heat generated by the fixing means; and an exhaust aperture for discharging the air flowing in the air path to the exterior of the apparatus.

Still another object of the present invention is to provide an image forming apparatus comprising:

sheet supply means;

image forming means for forming an image on a sheet fed by the sheet supply means;

fixing means for fixing the image formed on the sheet;

a sheet guide for guiding the movement of the sheet, the sheet guide being provided between the sheet supply means and the fixing means and being so positioned substantially linearly that the sheet moves upward in an inclined direction;

an electric supply portion including a power source for supplying the main body of the apparatus with an electric power, the electric supply portion being provided in a lower part of a space formed under the sheet guide;

an air path for introducing the external air from a lower part of the apparatus and generating an air flow utilizing the heat generated by the fixing means; and an exhaust aperture for discharging the air flowing in the air path to the exterior of the apparatus.

Still another object of the present invention is to provide an image forming apparatus comprising:

sheet supply means;

image forming means for forming an image on a sheet fed by the sheet supply means;

fixing means for fixing the image formed on the sheet;

a sheet guide for guiding the movement of the sheet, the sheet guide being provided between the sheet supply means and the fixing means and being so positioned substantially linearly that the sheet moves upward in an inclined direction;

a first air path for introducing the external air from a lower part of the apparatus and generating an air flow utilizing the heat generated by the fixing means; and a first exhaust aperture for discharging the air flowing in the first air path to the exterior of the apparatus;

a second air path for introducing the external air from a lower part of the apparatus and generating an air flow utilizing the heat generated by an electric supply portion provided in a lower part of a space formed under the sheet guide; and a second exhaust aperture for discharging the air flowing in the second air path to the exterior of the apparatus.

Still another object of the present invention is to provide an image forming apparatus comprising:

sheet supporting means for supporting sheets;

sheet supply means for supplying the sheet from the sheet supporting means;

image forming means for forming an image on the sheet;

fixing means for fixing the image formed on the sheet;

wherein a sheet conveying path from the sheet supply means to the fixing means is substantially linear and substantially parallel to the diagonal of a frame supporting the sheet conveying path.

Still another object of the present invention is to provide an image forming apparatus comprising:

a base frame including two side plates provided perpendicularly to an installation plane of the apparatus, a plate-shaped first stay mounted to the two side plates and positioned at the bottom side of the side plates, a plate-shaped second stay mounted to the two side plates and positioned in an upper side of the apparatus, and a plate-shaped third stay positioned between the first and second stays;

wherein the first, second and third stays are provided in a substantial Z-shape between the two side plate.

Still other objects of the present invention will become fully apparent from the following detailed description which is to be taken in conjunction with the accompanying drawings.

DETAILED DESCRIPTION OF THE PREFERRED EMBODIMENTS

Now the present invention will be clarified in detail, by an image forming apparatus embodying the present invention. In the present embodiment, a laser beam printer will be taken as an example of the image forming apparatus.

Figure 1:
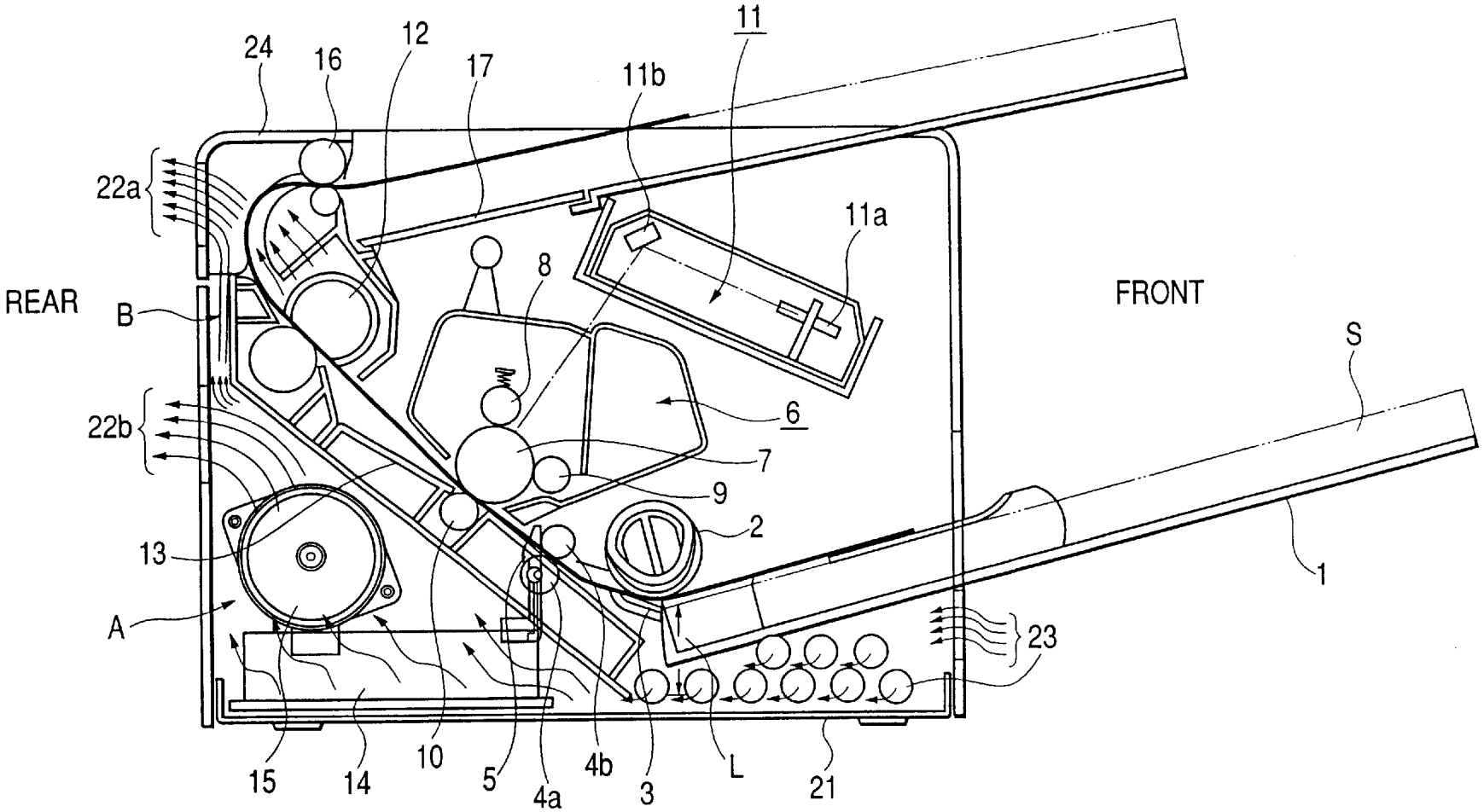
FIG. 1 is a schematic cross-sectional view of an image forming apparatus constituting a first embodiment of the present invention.

FIG. 1 is a schematic cross-sectional view of a printer embodying the present invention. The configuration of the printer will be explained in the following.

A sheet cassette 1, constituting sheet supporting means, is detachably mounted on the main body of the apparatus. The sheet cassette 1 contains sheets S, which are fed one by one with a sheet supply roller 2 constituting sheet supply means and a separating pad 3 for separating a sheet by contact with the sheet supply roller 2. The advanced sheet S is conveyed further downstream by paired conveying rollers 4*a*, 4*b*.

A sensor 5 is provided at the downstream side of the paired conveying rollers 4 in the sheet conveying direction, for detecting the position of the sheet S. The detecting operation of the sensor 5 will be explained later. At the downstream side of the paired conveying rollers 4 there are provided a photosensitive drum 7, a primary charger 8 for uniformly charging the surface of the drum, a developing device 9 for depositing toner onto the charged surface of the drum 7 and a toner container for containing toner, constructed integrally as a process cartridge 6. In a position opposed to the photosensitive drum 7 across the sheet conveying path, a transfer roller 10 is provided as transfer means for transferring the toner image, deposited on the photosensitive drum 7, onto the sheet S.

A laser scanner 11 for drawing image information on the photosensitive drum 7 charged by the charger 8 irradiates the photosensitive drum 7 with image information converted into a laser beam, after reflection by mirrors.

Such photosensitive drum, charger, laser scanner, developing device, transfer roller etc. constitute image forming means.

Paired fixing rollers 12 constituting fixing means pinch therebetween the sheet S bearing the toner image, thereby fixing the image permanently to the sheet S by the pressure between the rollers and the heat supplied thereto.

The sheet S bearing the toner image fixed by the paired fixing rollers 12 is diverted in direction and discharged by paired discharge rollers 16 onto a sheet discharge tray 17.

The conveying of the sheet from the sheet supply roller 2 to the paired fixing rollers 12 is limited by a sheet guide 13 for guiding the lower side (opposite to the image bearing side) of the sheet S.

Under the sheet guide 13, a control board 14 is provided substantially horizontally at the bottom face of the casing of the apparatus, as control means including a power source and serving to control the image forming operation and the sheet supplying operation. Also a drive motor 15, constituting drive means for driving the main body of the apparatus, is fixed to a lateral face of the casing of the apparatus, in a position lower than the sheet guide 13.

In the following there will be explained the function of the printer of the above-described configuration.

The printer serves to form, on the sheet S, a visible toner image corresponding to image information transmitted through a network. The image information transmitted through an unrepresented network to the printer in a stand-by state is entered into an unrepresented video controller provided in the control board 14. Based on the transmitted data, the video controller prepares an image signal.

The prepared image signal is transmitted to an unrepresented controller provided on the control board 14 and serving as a control portion of the printer. In response to such signal, the controller prepares a laser drive signal. It also starts the rotation of the sheet supply roller 2, and separates and advances a sheet S from the sheet cassette 1 in cooperation with the separating pad 3.

The separated sheet S is conveyed toward the image forming portion, and conveyed further downstream by being pinched between the paired conveying rollers 4. When the leading end of the sheet S is detected by the sensor 5, the controller transmits the laser drive signal to the laser scanner 11 in synchronization with such detection.

In response to the laser drive signal transmitted to the laser scanner 11, a laser unit provided therein emits a laser beam toward a rotating scanning mirror 11*a*. The laser beam deflected by the scanning mirror 11*a* is guided to a mirror 11*b* for deflection toward the photosensitive drum 7.

The surface of the photosensitive drum 7 is already uniformly charged by the charger 8. The irradiation with the laser beam dissipates the charge in the irradiated portion, thereby forming an electrostatic latent image on the drum. The developing device 9 deposits toner onto the drum bearing the electrostatic latent image, thereby forming a visible image.

The toner image is transferred in continuous manner by the transfer roller 10 onto the sheet S conveyed in synchronization with the timing of image formation. After the transfer, the sheet S is further conveyed and is pinched in the nip of the paired fixing rollers 12 whereby the toner is fixed to the sheet S by heat and pressure. Then the sheet S is discharged by the paired discharge rollers 16 and stacked on the sheet discharge tray 17.

The above-described operation is repeated for a designated number of times, and the printer returns to the stand-by state after the discharge of the final sheet S.

In the following there will be given a detailed explanation, with reference to FIGS. 1 and 2, on the configuration of an external cover 24 and a frame serving as the casing of the printer, principally including the sheet guide 13 constituting the sheet conveying path and featuring the present invention.

The external cover 24 and the frame of the present embodiment are composed of paired conductive side walls 18, 19 positioned at left and right, a resinous sheet guide 13 supported therebetween, a conductive scanner plate 20 for supporting the laser scanner 11, and a conductive bottom plate 21 at the lowermost portion of the image forming apparatus. The side walls 18, 19 are composed of metal plates since a conductive material is desired for securing the rigidity of the apparatus and achieving electrical grounding and electromagnetic shielding.

As explained in the foregoing, the drive motor 15 constituting the drive means is fixed on the side wall 18. Such direct fixing of the drive motor 15 on the side wall allows to dissipate the heat generated by the drive motor 15 to the side wall 18, and the vibration can be lowered by fixation to the highly rigid metal plate. Also electrical grounding can be easily achieved.

The sheet guide 13 is so formed as to provided a portion for supporting the principal units such as the paired conveying rollers 4, transfer roller 10, paired fixing rollers 12 etc. and to guide the conveyed sheet S. A complex shape is integrally formed by a single member for reducing the cost by decreasing the number of parts and for reducing the assembling cost, and a plastic material of high heat insulating efficiency is employed in order to insulate the heat generated from the control board 14 and the drive motor 15 positioned in the lowermost part of the apparatus. As explained above, the sheet guide 13 is mounted on the two side walls 18, 19.

The sheet guide 13 may be composed of a material same as that of the external cover 24, thereby facilitating recycling of the image forming apparatus. The recycling of an external member of the apparatus is principally achieved by forming an external member again or by using as a material for another purpose.

However the re-utilization for the external member is generally difficult technically and in cost, because the issues of contamination by other materials and color matching have to be resolved. On the other hand, the re-utilization for a functional part in the apparatus is easier since such issues are not very important. In such case, therefore, there can be adopted materials practical for the recycling.

Besides, the sheet guide 13, being fixed to the side walls 18, 19 in an inclined manner, exhibits an effect of increasing the ridigity of the apparatus in the lateral direction thereof. Also the sheet guide 13, being provided substantially linearly in a slanted ascending position toward the paired fixing rollers 12 at the uppermost end within the casing of the apparatus, not only realizes a short sheet conveying path for improving the throughput of image formation but also allows efficient positioning of the process cartridge 7, the laser scanner 11, the control board 14 and the drive motor 15 around the sheet guide 13, thereby enabling compactization of the image forming apparatus.

Metal plates of high rigidity are employed for the scanner plate 20 in order to suppress the vibration resulting from the rotation in the laser unit 11*a* and for the bottom plate 21 in the lowermost part of the apparatus in order to realize rigidity for supporting the total weight of the apparatus and electromagnetic shielding for the control board 14. The above-described frame configuration attains a low cost while meeting the requirements of heat insulation, high rigidity and suppression of vibration.

The scanner plate 20 and the bottom plate 21 are mounted on the side walls 18, 19. As shown in FIGS. 1 and 2, the bottom plate 21 (first stay), the scanner plate 20 (second stay) and the sheet guide 13 (third stay) are positioned in a substantial Z-shape between the two side walls 18, 19, whereby the rigidity of the frame is improved by a simple configuration.

In the printer of the present embodiment, as shown in FIG. 1, the sheet guide 13 is provided with the paired fixing rollers 12 at the uppermost end, and conveys the sheet S thereto substantially linearly in an inclined upward manner from the sheet supply position where the sheet supply roller 2 is located. In the present embodiment, the sheet guide 13 is provided in the printer at an angle of 45° with respect to the horizontal plane, for the reason to be explained later.

As the conveying angle of the sheet S is inclined with respect to the horizontal plane and is substantially linear, a major diversion in the direction is not required in the sheet conveying to the paired fixing rollers 12, so that there can be avoided drawbacks deteriorating the stability of the image formation such as distorted or skewed sheet feeding.

In the following there will be explained the effect of dissipating the heat generated in the apparatus.

It is rendered easier to dissipate the heat generated by the paired fixing rollers 12, thereby preventing the temperature increase in the apparatus, by positioning the paired fixing rollers 12, releasing a large amount of heat, in the uppermost part of the apparatus and by providing a louver 22*a* as a first aperture in the upper part of the external cover 24 in the vicinity of the paired fixing rollers 12. As the heat generated from the fixing rollers 12 naturally moves upwards, the process cartridge 6 and the laser scanner 11 positioned lower than the fixing rollers 12 can be prevented from the influence of such heat.

Figure 2:
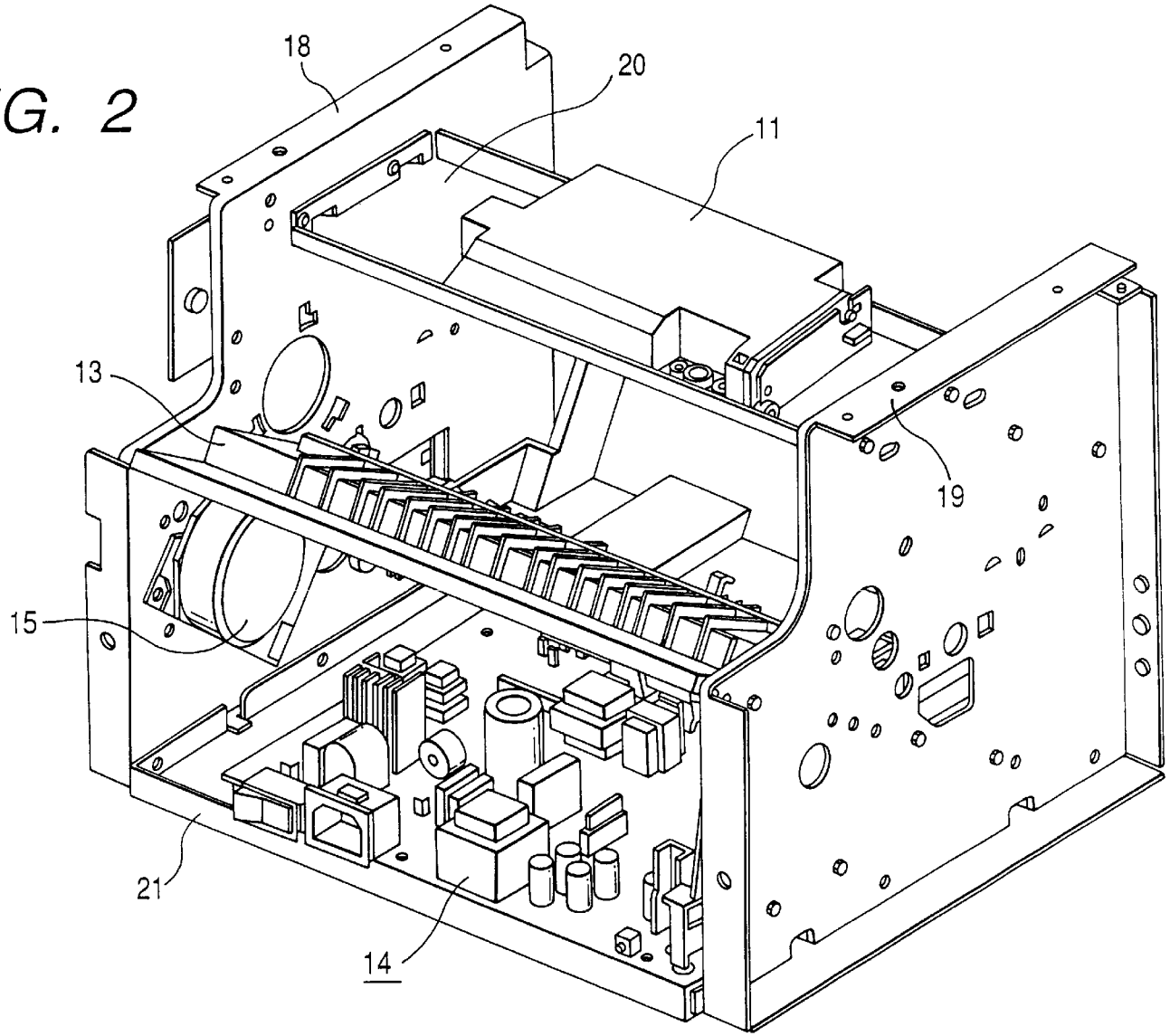
FIG. 2 is a perspective view of the image forming apparatus of the first embodiment, without an external cover and seen from an inclined rear direction.

Under the sheet guide 13, there is formed, as shown in FIGS. 1 and 2, a space A of a triangular cross-sectional shape defined by the sheet guide 13 from the sheet supply roller 2 to the paired fixing rollers 12, the bottom plate 21 and the side walls 18, 19. In the present embodiment, as explained in the foregoing, the control board 14 for controlling the apparatus and the drive motor 15 are positioned in this space A.

The heat generated from the control board 14 and the drive motor 15 is released in the space A to gradually elevate the temperature therein. However, as the sheet guide 13 constituting the sheet conveying path is provided in an inclined manner with respect to the horizontal plane (bottom plate 21) above the control board 14, the heat generated from the control board 14 and the drive motor 15 spontaneously flows to a higher part of the space at the side of the paired fixing roller 12. Thus the heat generated by the control board 14 and the drive motor 15 does not stay around such components.

The external cover 24 is provided, in the vicinity of the uppermost part of the space A, with a second louver 22*b* constituting a second aperture, whereby the heat moving toward the upper part of the space A is discharged through the louver 22*b* to the exterior of the apparatus. Thus the inclined configuration of the sheet guide 13 with respect to the bottom plate 21 allows to spontaneously generate an air flow from the lowermost part of the apparatus where the control board 14 is located to the paired fixing rollers 12 in the uppermost part of the apparatus, without requiring a fan or the like for forcedly generating such air flow.

The heat generated from the fixing rollers 12 is discharged to the exterior of the apparatus through the louver 22*a* provided in the external cover 24 as explained in the foregoing. A space B constituting an air duct is provided between the external cover 24 and the rear side, opposite to the front side of the apparatus, of the fixing rollers 12, so that an air flow is generated at the discharge of the heat generated by the paired fixing rollers 12 to the exterior. Such space B extends from the position of the louver 22*a* to the space A containing the control board 14 and the drive motor 15 under the sheet guide 13.

Consequently the heat generated from the control board 14 and the drive motor 15 is collected, by the sheet guide 13 provided in inclined manner with respect to the bottom plate 21, in the uppermost portion of the space A, namely a portion where the space A communicates with the space B. Since an air flow toward the exterior of the apparatus is generated in the space B by the discharge of heat released from the fixing rollers 12 to the exterior through louver 22*a*, the heat generated in the lowermost part of the apparatus and collected in the upper part of the space A along the sheet guide 13 is also discharged to the exterior of the apparatus through the louver 22*b*, along with the air flow generated by the paired fixing rollers 12. Otherwise such heat also passes through the space B together with the heat generated from the fixing rollers 12, and is therefore discharged through the louvers 22*a*, 22*b* to the exterior of the apparatus.

However, in order to continuously generate the air flow for moving the heat generated from the control board 14 and the drive motor 15 toward the paired fixing rollers 12, it is necessary to introduce the external air into the image forming apparatus. In the present embodiment, such air flow is generated by forming a suction aperture 23 in the external cover under the sheet cassette 11 thereby introducing the external air into the space A through under the supply means including the sheet cassette 1 and the sheet supply roller 22.

A distance L between the bottom plate 21 and the sheet supply roller 2 as shown in FIG. 1 is desirable to be set larger for stimulating the flow of the external air introduced into the space A through the suction aperture 23, but such distance L is selected as 20 mm in the present embodiment, in order to achieve compactization of the apparatus and still to achieve introduction of the external air into the space A. In other words, efficient introduction of the external air into the space A can be achieved with a distance L at least equal to 20 mm, and it was experimentally confirmed, as will be explained later, that such external air introduction can sufficiently prevent the temperature increase in the apparatus.

The heat generated by the paired fixing rollers 12 positioned above the control board 14 is discharged to the exterior of the apparatus through the louver 22*a*, or the first aperture, provided in the external cover 24. Also a space B as an air flow duct extending to the space A is provided between the lower part of the paired fixing rollers 12 and the casing of the apparatus can stimulate the air discharge from the space A.

Such space or duct B allows to stimulate the air flow for discharging the heat generated from the control board 14, thereby easily discharging the heat generated from the control board 14 and the drive motor 15, through the louver 22*b* constituting the second discharge means provided in the external cover 24. It is thus rendered possible to spontaneously discharge the heat generated in the apparatus without employing an exhaust fan or the like, and to provide an image forming apparatus which is quiet and inexpensive.

In the present embodiment, the apertures for discharging the heat from the interior of the apparatus are formed as first and second apertures, but the scope of the present invention is not limited by the number of such apertures.

Also the intensity of the air flow varies by the angle between the control board 14, constituting the control means provided horizontally on the bottom plate 21, and the sheet guide 13, namely by the area of the space A above the control board 14. In the present embodiment, the angle between the control board 14 and the sheet guide 13 is selected as 45° as explained in the foregoing, for the reason to be explained in the following.

The following table shows the results of temperature measurement of the process cartridge 6, laser scanner 11 and control board 14 when the angle between the bottom plate 21 and the sheet guide 13 is changed as 0°, 30°, 45° and 60°.

TABLE 1

| | 0° | 15° | 30° | 45° | 60° |
|---|---|---|---|---|---|
| process cartridge | 57.3° C. | 53.1° C. | 49.1° C. | 47.3° C. | 45.7° C. |
| laser scanner | 69.6° C. | 66.9° C. | 65.5° C. | 61.5° C. | 58.4° C. |
| control board | 61.8° C. | 56.2° C. | 51.2° C. | 48.1° C. | 44.6° C. |

As shown in the table, the temperatures of the components becomes lower as the angle between the bottom plate 21 and the sheet guide 13 becomes larger. The probability of toner fusion becomes higher if the temperature of the toner in the process cartridge 6 exceeds 50° C. Since the use of the fused and adhered toner results in defective image formation, the upper limit temperature allowable to the toner is considered 50° C.

In consideration of a certain tolerance for the upper limit temperature of 50° C., the angle between the bottom plate 21 and the sheet guide 13 in the present embodiment is selected as about 45°.

However, the temperatures shown in the foregoing table are measured at the surface of the frame of the process cartridge 6. Therefore, the actual temperature inside the toner container is sufficiently lower than the value shown in the foregoing table, so that an angle equal to or larger than 30° can be safely adopted between the bottom plate 21 and the sheet guide 13. Also the temperature of the laser scanner 11 is not so high as to influence the optical system, so that satisfactory image forming operation can be executed.

On the other hand, as the angle between the bottom plate 21 and the sheet guide 13 approaches 90°, the sheet conveying needs to be more precise and requires additional cost, as explained in the prior art. Therefore, in consideration of the compatibility of the low cost and the prevention of temperature increase in the apparatus, the angle is selected within a range from about 30° to about 60°. A smaller angle allows to reduce the height of the apparatus, but increases the footprint thereof. On the other hand, a larger angle allows to reduce the footprint of the apparatus, but increases the height thereof.

In the present embodiment, the angle between the bottom plate 21 and the sheet guide 13 is selected as 45°, in consideration of the cost, the footprint and height of the apparatus.

Figure 3:
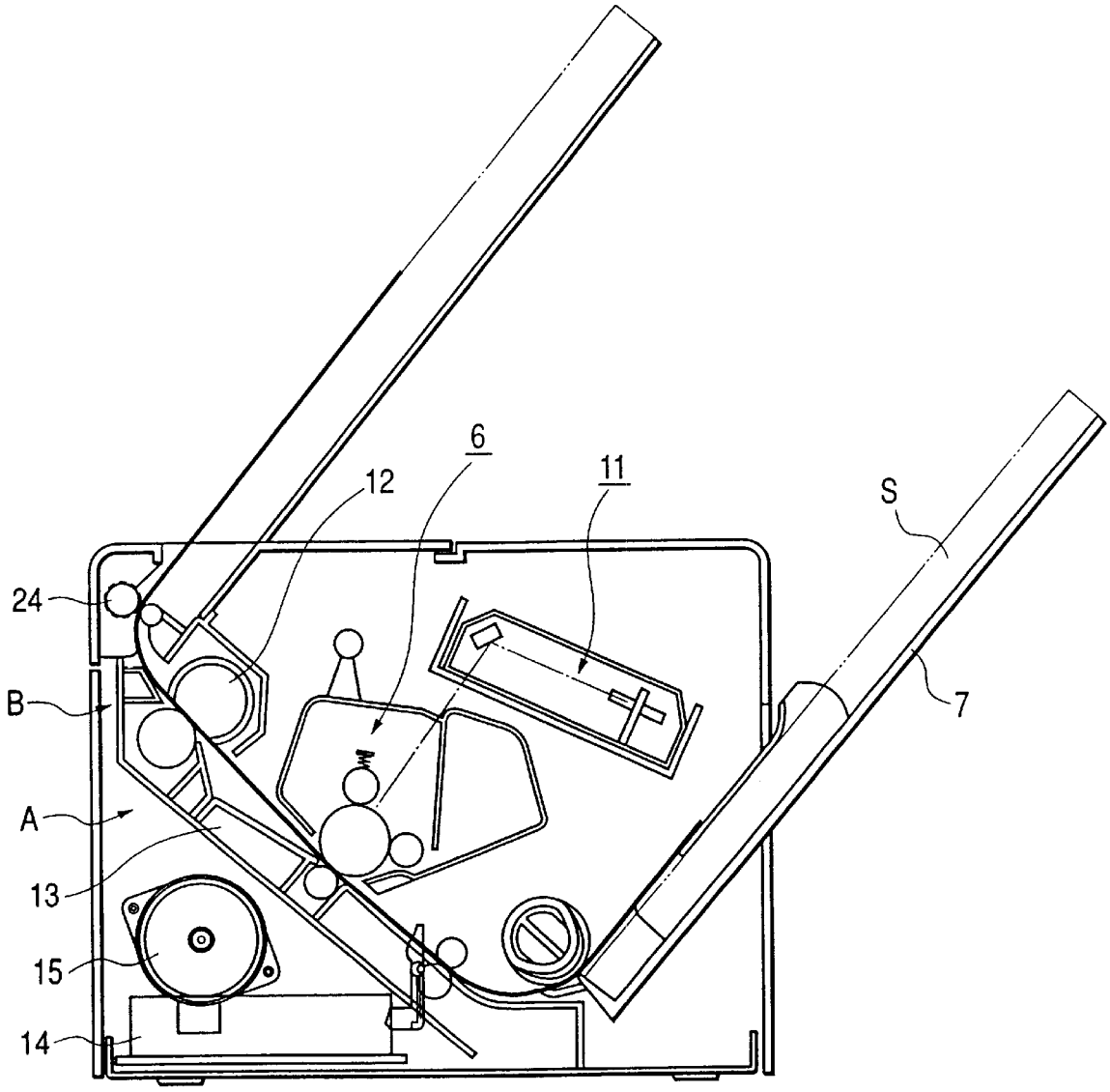
FIG. 3 is a schematic cross-sectional view of an image forming apparatus constituting a second embodiment of the present invention.
Figure 4:
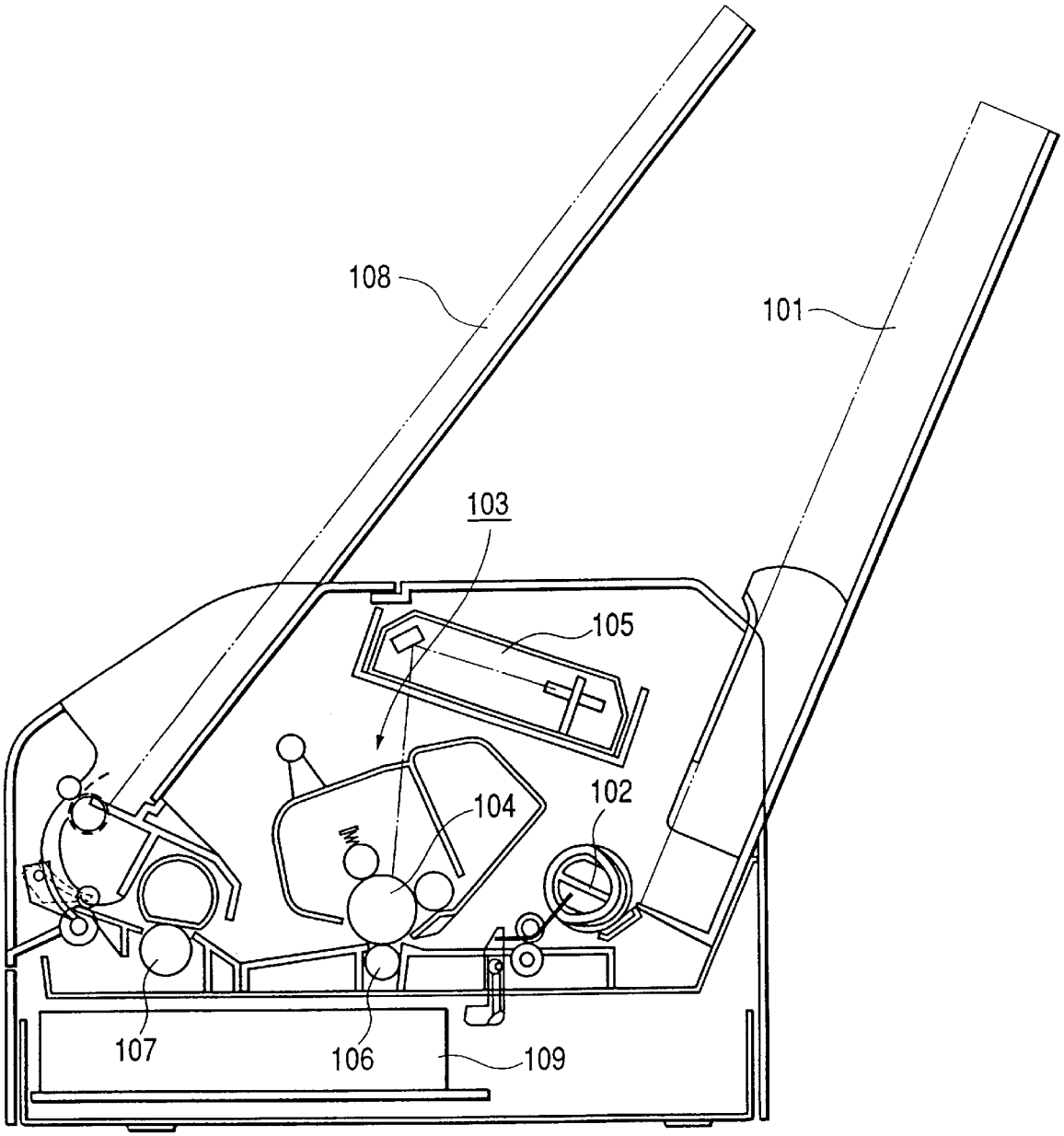
FIG. 4 PRIOR ART
FIGS. 4 and 5 are schematic cross-sectional views of a conventional image forming apparatus.

In a second embodiment of the image forming apparatus shown in FIG. 3, the sheet guide 13 is provided as explained in the foregoing but the mounting angles of the sheet cassette 1 and the sheet discharge tray 17 are changed with respect to the main body of the apparatus. Such configuration provides advantages of reducing the footprint of the apparatus and facilitating the elimination of the discharged sheets.

As explained in the foregoing, by forming a space A of triangular cross-sectional shape under the paired fixing rollers 12 by means of the sheet guide 13, placing the control board 14 and the drive motor 15 in such space A and also forming a duct space B under the paired fixing rollers 12 for connecting the fixing rollers 12 and the space A, it is rendered possible to generate a spontaneous air flow for air discharge and heat dissipation in the area from the control board 14 and the drive motor 15 in the lowermost part of the apparatus to the paired fixing rollers 12 even without employing a fan for cooling or air discharge, thereby resolving heat accumulation in the image forming apparatus and preventing the temperature elevation therein.

It is thus rendered possible not only to realize a configuration not requiring the fan thereby achieving cost reduction but also to eliminate the rotation noise of such fan thereby providing a quiet image forming apparatus.

Also the sheet guide 13 is composed of a member of a plastic material of high heat insulating effect, thereby protecting the process cartridge 7 and the laser scanner 11 constituting the image forming portion form the influence of heat.

Furthermore, the space defined by the sheet guide 13 and the casing of the apparatus can be effectively utilized. More specifically, components of relatively high heat generation are mounted on the vertical plane side of the apparatus while those of relative low heat generation are provided on the horizontal plane side, whereby the heat discharging effect can be further enhanced.

Also as the sheet is conveyed substantially linearly and in an inclined direction with respect to the horizontal plane, the sheet conveying does not involve a major diversion in the direction, so that the drawbacks deteriorating the stability of image formation, such as distorted or skewed sheet conveying, no longer occur. It is furthermore possible to reduce the frictional sound generated by the sheet upon colliding with the sheet guide.

Figure 5:
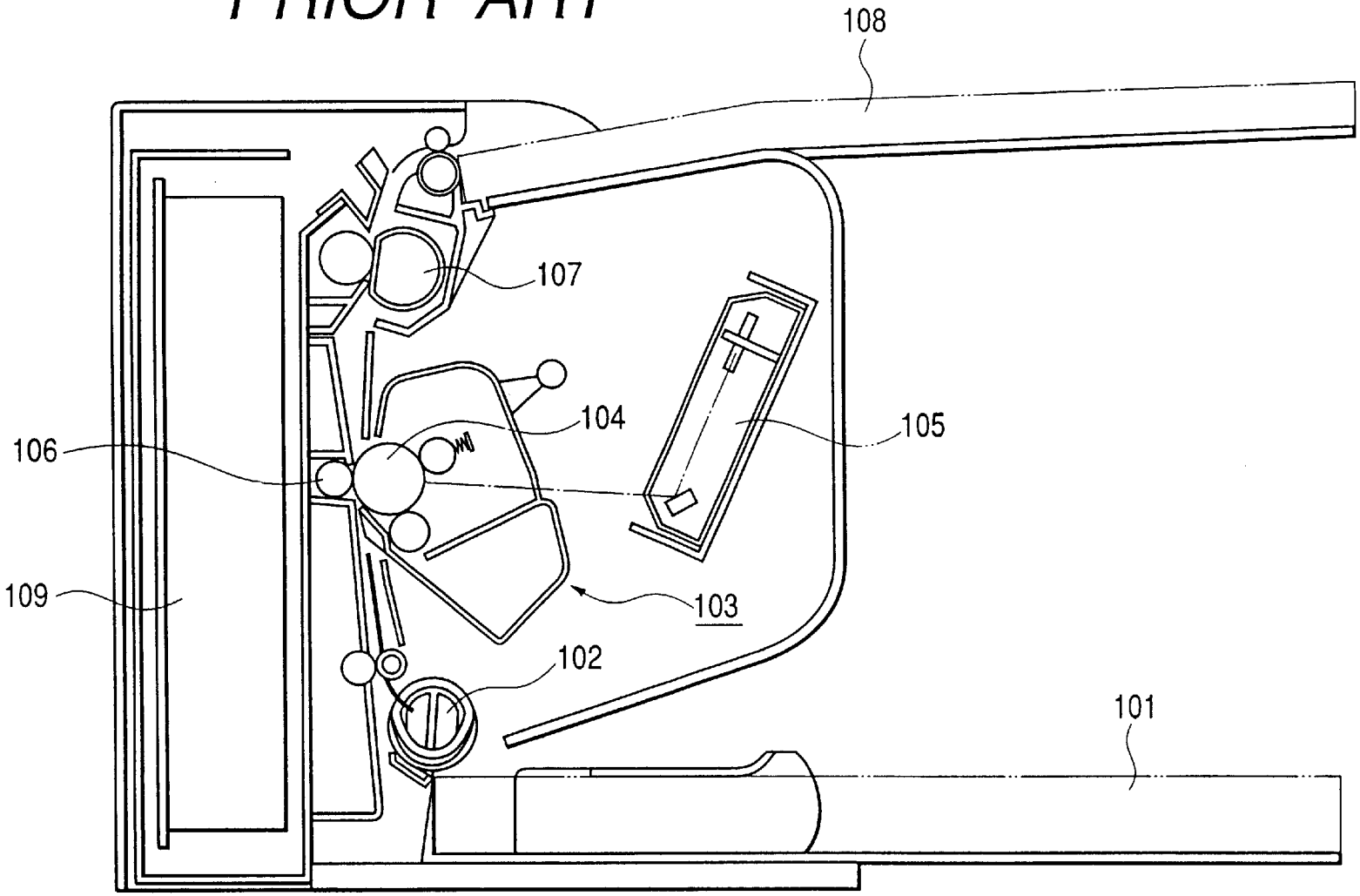
FIG. 5 PRIOR ART

Furthermore, in comparison with the printer employing vertical sheet conveying as shown in FIG. 5, the requirement for the conveying precision is milder so that the manufacturing cost can be reduced for example by reducing the number of the paired rollers and the guide members for sheet conveying.

Also in the present embodiment, as the sheet guide 13 constituting the sheet conveying path is provided substantially parallel to the diagonal of the frame of the apparatus, other members of the apparatus can be provided efficiently.

In the following there will be explained a third embodiment of the present invention.

Figure 6:
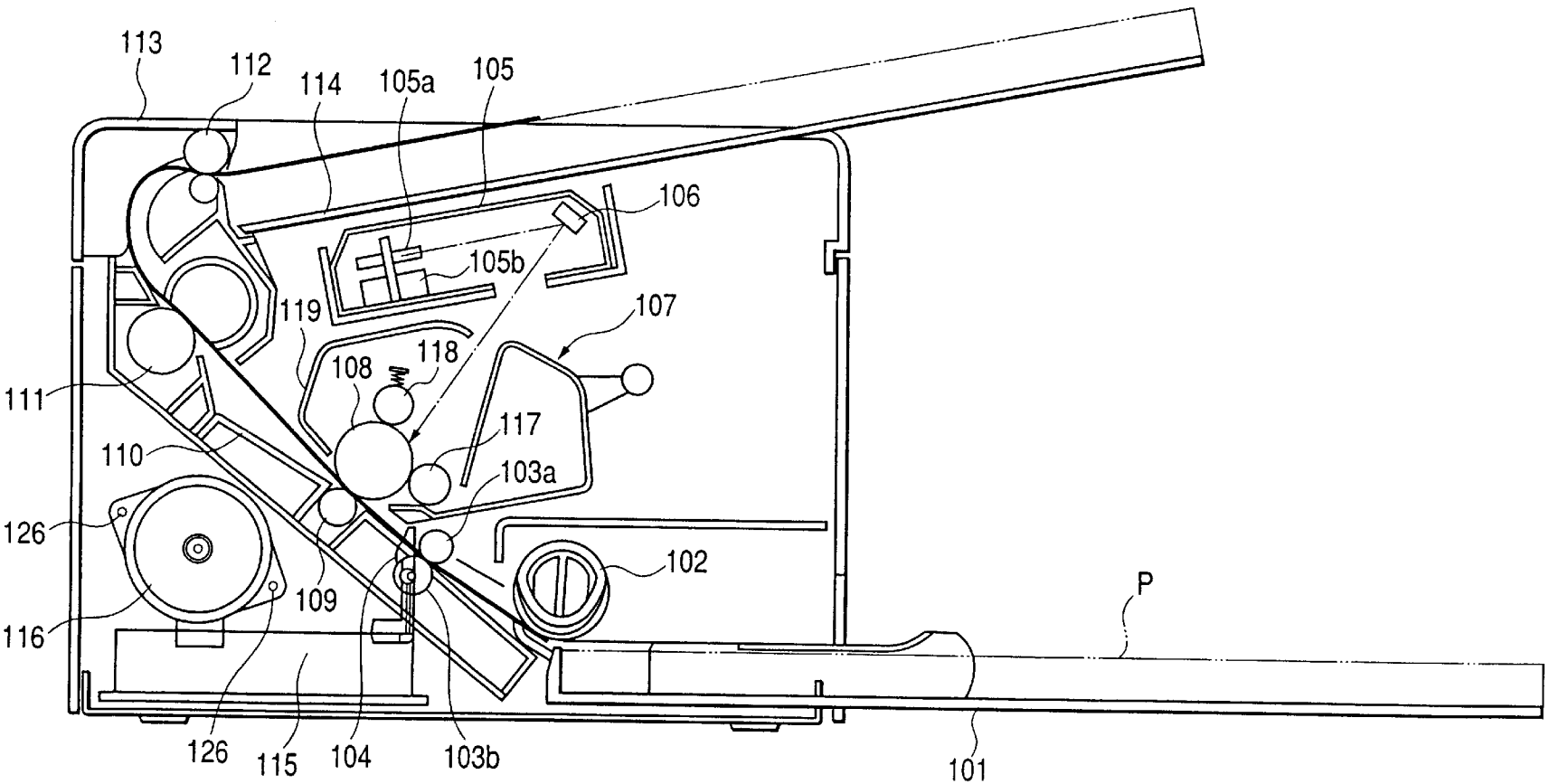
FIG. 6 is a schematic cross-sectional view of an image forming apparatus constituting a third embodiment of the present invention.

FIG. 6 is a cross-sectional view of a laser beam printer constituting an image forming apparatus of the present invention, and the illustrated laser beam printer employs an electrophotographic process for achieving recording by scanning a photosensitive member with a laser beam.

Referring to FIG. 6, a sheet cassette 101 detachably mounted on the main body of the apparatus contains plural stacked recording sheets P. A recording sheet P is separated by a sheet supply roller 102 provided in the upper front end of the sheet cassette 101 and is conveyed to a transfer portion by conveying rollers 103*a*, 103*b*.

There are also shown a registration sensor 104 and a mirror 106. The registration sensor 104 serves to synchronize the leading end position of the recording sheet P and the timing of light emission of a laser scanner 105 constituting an exposure light source, thereby starting to draw an image from a predetermined position on the recording sheet P.

A process cartridge 107 integrally incorporates a photosensitive member 108, a developing device 117, a charging roller 118, a cleaner 119 etc. There are also shown a transfer roller 109 for transferring a visible image, formed on the photosensitive member 108, onto the recording sheet P, and a conveying guide 110 for guiding the recording sheet P after the visible image transfer to a fixing device 111, which fixed the visible image on the recording sheet P by heating. The recording sheet P bearing the fixed image is discharged by discharge rollers 112 onto a sheet discharge tray 114 integrally formed with an external cover 113.

(Conveying Angle of Recording Sheet)

As shown in FIG. 6, sheet supply means consisting of the aforementioned sheet cassette 101 and the sheet supply roller 102, transfer means for transferring the visible image from the photosensitive member 108 onto the recording sheet P by the transfer roller 109, and the fixing device 111 for heat fixing the visible image on the recording sheet P are positioned substantially linearly in an inclined upward direction with the fixing device 111 at the uppermost position.

The recording sheet P stacked in the sheet cassette 101 is, after being advanced by the sheet supply roller 102, conveyed by the conveying rollers 103*a*, 103*b* to the transfer portion along the substantially linear conveying path, and is thereafter conveyed, by pinching between the photosensitive member 108 and the transfer roller 109, to the fixing device 111 simultaneously with the transfer of the visible image. Since the conveying path in these operations is substantially linear, there can be reduced the frictional noise generated by the conveying guide 110 and the recording sheet P in the conveying thereof, and the recording sheet P can be conveyed in stable manner to achieve a high reliability in the sheet conveying.

Also, as the fixing device 111 is provided in the uppermost portion of the recording sheet conveying path, the heat generated from the fixing device 111 can be discharged to the exterior of the apparatus through an unrepresented louver formed in the external cover 113 even in case of a continuous printing operation.

Also the process cartridge 107 and the laser scanner 105, being positioned under or at a side of the fixing device 11, are not influenced by the heat generated therefrom, thereby constantly capable of providing a satisfactory output image.

In the present embodiment, various mechanisms can be positioned efficiently by providing the recording sheet conveying path substantially parallel to or on the diagonal of the apparatus, thereby achieving compactization of the apparatus.

(Arrangement of Laser Scanner)

Figure 7:
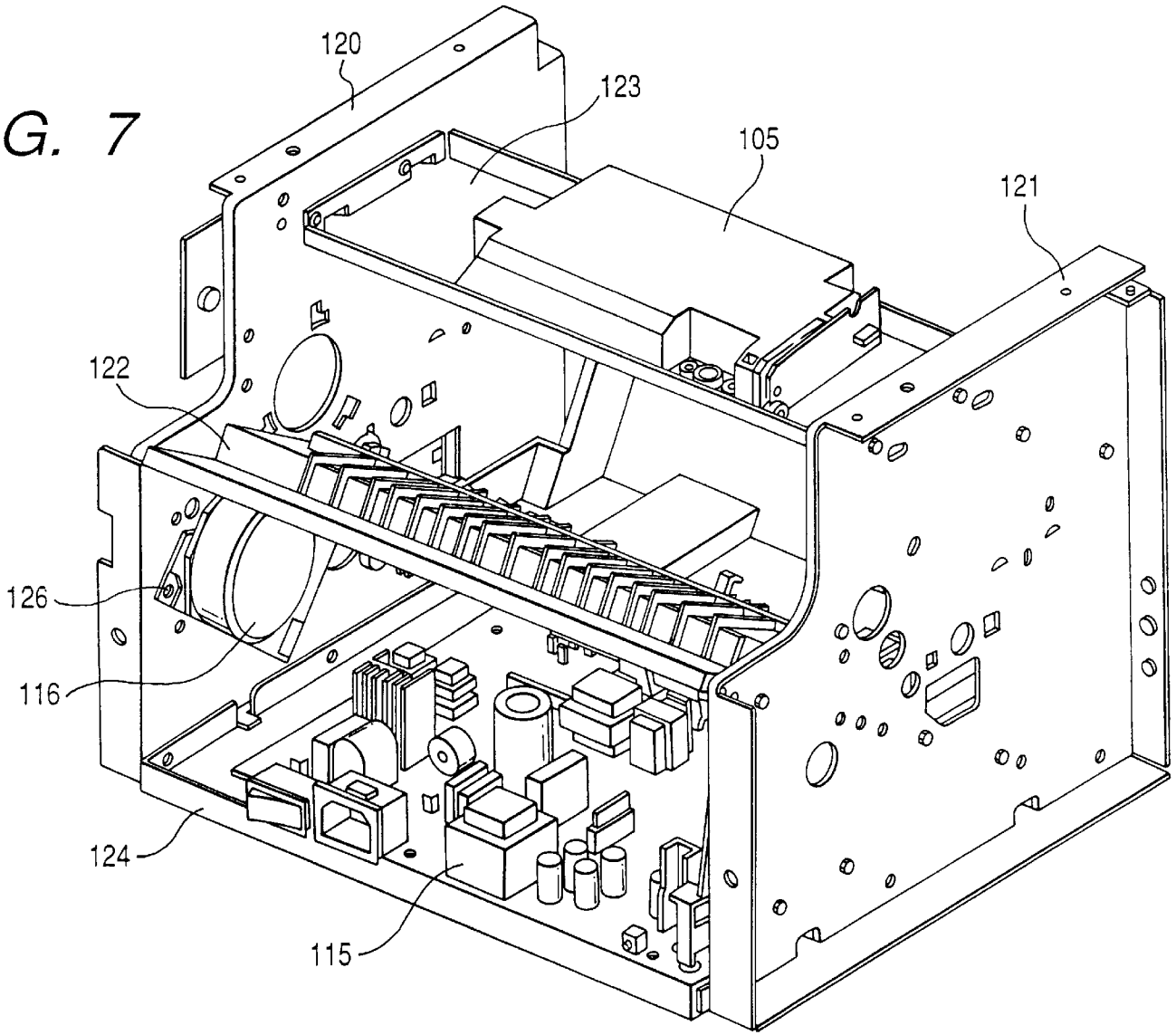
FIG. 7 is a perspective view of the image forming apparatus of the third embodiment, without an external cover and seen from an inclined rear direction.
Figure 8:
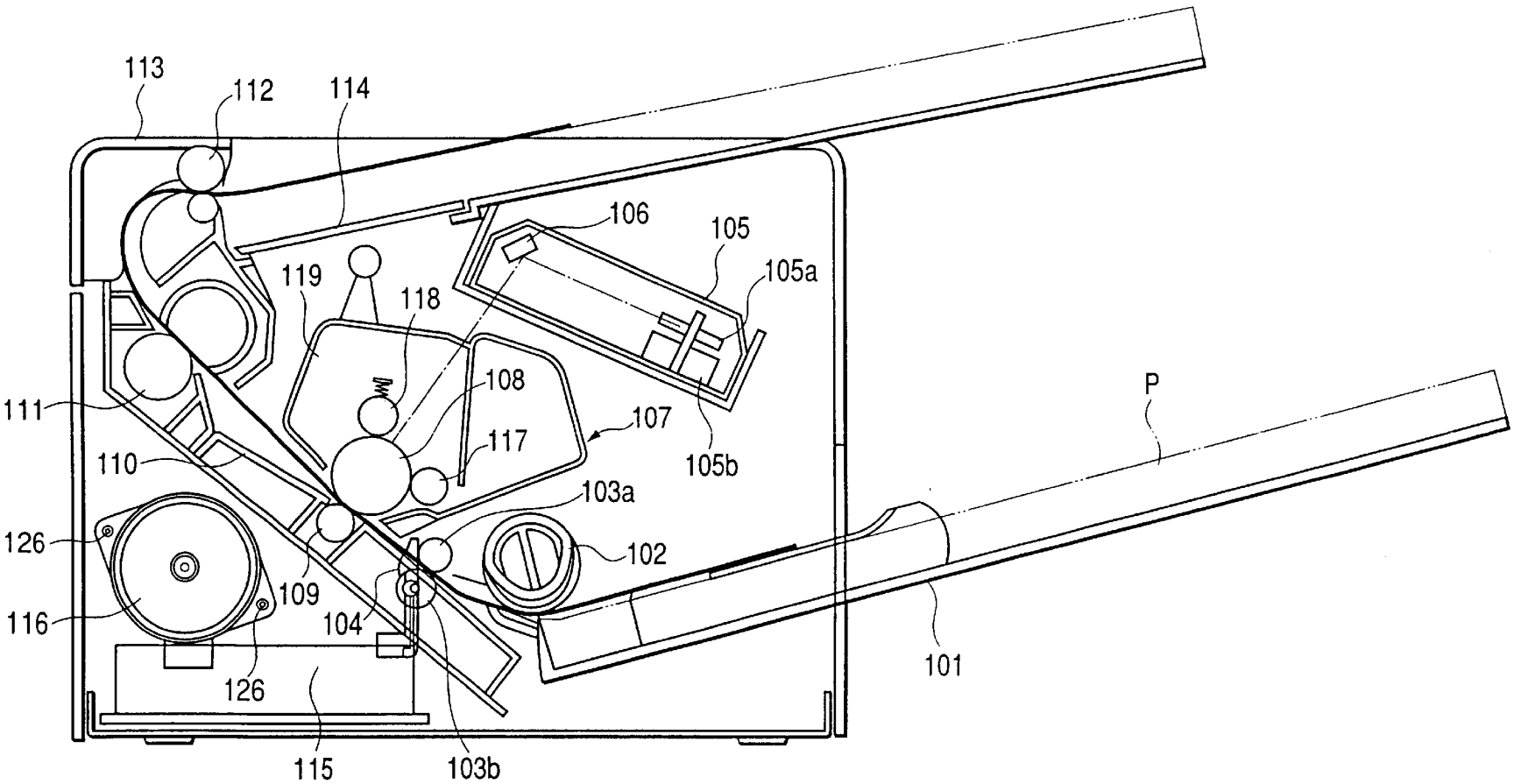
FIG. 8 is a cross-sectional view of a variation of the third embodiment.
Figure 9:
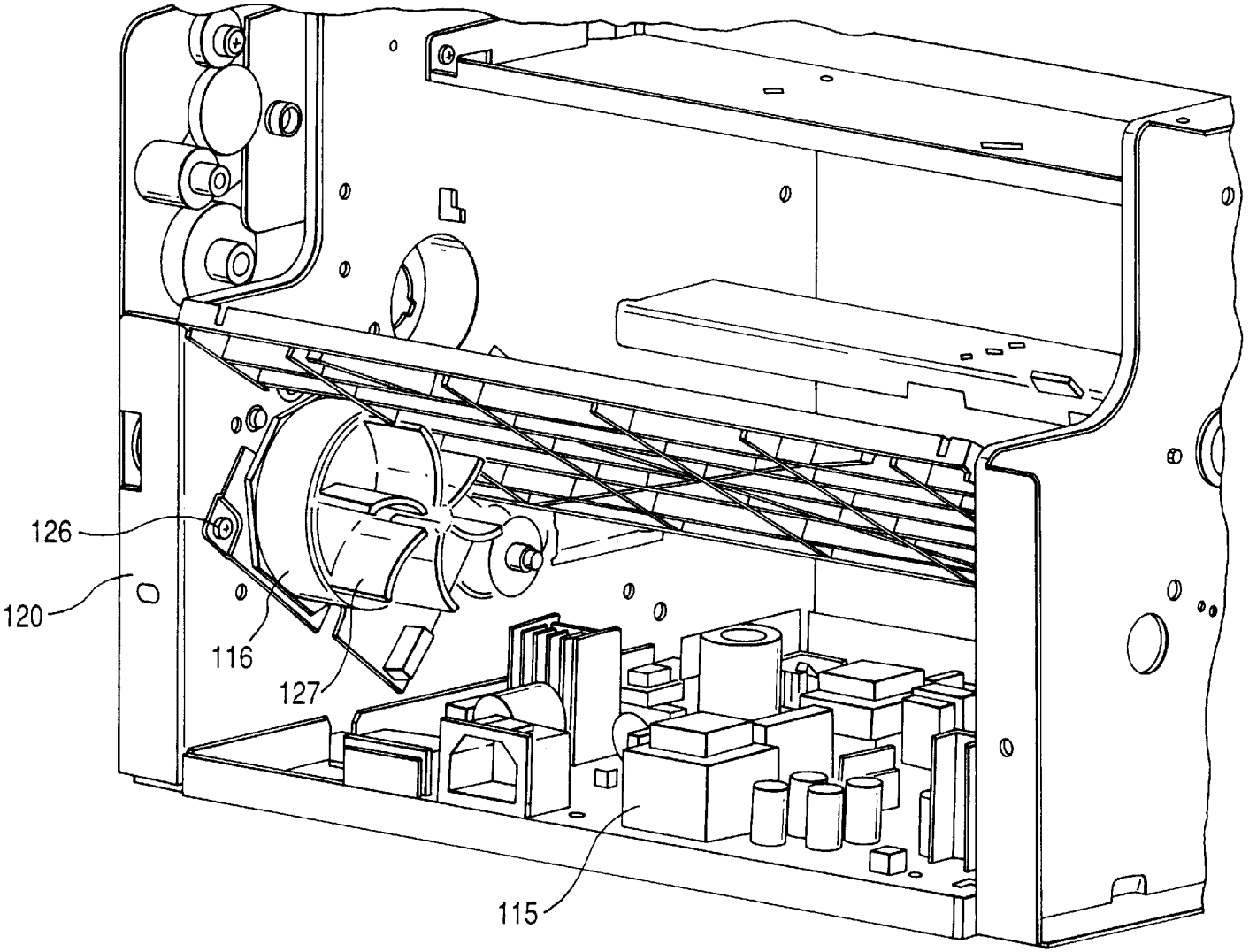
FIG. 9 is a perspective view of the variation of the third embodiment.

FIG. 7 is a perspective view of the principal parts of the laser beam printer shown in FIG. 6, and FIG. 8 is a cross-sectional view of a laser beam printer of another embodiment, wherein a laser scanner 105 is provided in an upper right position of a polygon mirror 105*a* as shown in FIG. 6, or in an upper left position as shown in FIG. 8. In order to reduce the dimension of the image forming apparatus as far as possible, it is most effective to introduce the laser beam to the photosensitive member 108 from a direction substantially perpendicular to the recording sheet conveying path consisting of the sheet supply means, transfer means and fixing means, as shown in FIGS. 6 and 8. Such configuration allows to minimize the depth and the height of the apparatus.

Also a scanner motor 105*b* for rotating the polygon mirror 105*a* is positioned substantially horizontally to eliminate the load on the bearing of the scanner motor 105*b*, thereby avoiding drawbacks such as a shortened service life thereof by the scraping of the bearing thereof and allowing to use the scanner motor 105*b* over a prolonged period.

In the configuration shown in FIG. 6, the process cartridge 107 can be attached or detached substantially horizontally toward or from the sheet discharge tray 114, whereby the jam processing and the replacement of the process cartridge 107 can be executed from a same direction and the usability can be improved.

Also in the configuration shown in FIG. 8, the process cartridge 107 is attached or detached from above, but the laser scanner 105 can be distanced from the fixing device 111 and can be affected less by the heat of the fixing device 111.

The incident angle of the laser beam selected in the present embodiment provides a larger freedom in the positioning of the laser scanner 105, thereby avoiding limitation in the usability and in the temperature elevation.

(Layout of Electric Supply System)

An electric supply system 115 including an AC power source, a DC power source and a high voltage source is positioned, as shown in FIG. 6, under the recording sheet conveying path arranged in an inclined upward direction form the sheet supply means to the fixing means, thereby securing a large space for the electric supply portion in the area from the sheet supply portion to the fixing portion and thus securing a path for the air flow generated by the heat from the electric supply portion 115.

Also the heat generated from the fixing device 111 positioned above the electric supply portion 115 is discharged to the exterior through the unrepresented louver provided in the external cover 113. Also by forming a space between the rear face of the fixing device 111 and the external cover 113, there can be generated an air flow in such space by the heat discharged from the fixing device 111.

As explained in the foregoing, by forming a large space under the fixing device 111, placing the electric supply portion 115 in such space and also forming a space behind the fixing device 111, it is rendered possible to generate an air flow for heat discharge in the range from the electric supply portion 115 to the fixing device 111 even without employing a cooling fan, thereby resolving heat accumulation in the apparatus and preventing the temperature elevation therein. As a result, there can be realized a fanless configuration to achieve cost reduction and there can be eliminated the noise of such fan thereby providing a quiet image forming apparatus.

Also as the space under the recording sheet conveying path arranged in the inclined upward direction form the sheet supply means to the fixing means can be effectively utilized, the electric supply portion 115 can be formed in an L-shaped layout consisting of a horizontal portion and a vertical portion, whereby the efficiency of the electric supply portion can be further improved. More specifically, components or elements of relatively high heat generation are mounted on the vertical plane side of the apparatus while those of relative low heat generation are provided on the horizontal plane side, whereby the heat discharge from the electric supply portion can be executed more efficiently.

(Arrangement of Drive Source)

A motor 116 constituting the drive source is composed of a DC motor or a stepping motor and is positioned under the recording sheet conveying path including the sheet supply means, transfer means and fixing means and directly mounted, with screws 126, on an internal surface of a conductive side wall constituting a part of the frame of the apparatus.

The above-mentioned positioning of the motor 116 under the recording sheet conveying path allows to flexibly adapt to a change to a larger motor or a change from the stepping motor to a DC motor in order to achieve a higher process speed in the image forming apparatus. It is therefore possible to easily achieve a higher speed for example from 10 ppm to 20 ppm.

Also the direct mounting of the motor 116 on the internal surface of the conductive frame 20 of the apparatus shown in FIG. 7 allows to dissipate the heat generated by the motor 116 itself easily to the entire conductive frame 120 thereby improving the efficiency of the motor and to facilitate grounding of the motor, thereby reducing the cost of the apparatus in total.

Also as the motor 116 is positioned inside the conductive frame 120, the motor pinion alone protrudes to the exterior of the frame whereby the driving portion can be made thinner without interfering with the gear train positioned outside the frame and the width of the entire apparatus can be reduced to achieve compactization of the apparatus.

Furthermore, by positioning the motor 116 and the electric supply portion 115 under the recording sheet conveying portion and by providing fins 127 above the rotor of the motor 116, there can be generated an air flow to achieve heat discharge from the electric supply portion 115 not only by spontaneous convection but also by forced convection.

(Frame Configuration)

The frame of the laser beam printer of the present embodiment is composed, as shown in FIG. 7, of conductive frames 120, 121 constituting a pair of conductive side walls, a resinous conveying plate 122 supporting the sheet supply means, conveying means, transfer means and fixing means, a conductive scanner plate 123 supporting the laser scanner 105 and a conductive bottom plate 124 supporting the electric supply portion 115 and provided in the lowermost part of the apparatus.

The above-mentioned conductive frames 120, 121 constituting the side walls at right and left are desirably composed of a conductive material in consideration of rigidity, ease of electrical grounding and electromagnetic shielding, and, in the present embodiment, they are composed of metal plates. As explained in the foregoing, the motor 116 is directly mounted on the conductive frame 120 at the left side and such material provides significant advantages in facilitating the heat dissipation, reduction of vibration and electrical grounding.

The conveying plate 122, including a portion for supporting the principal units such as the sheet supply means, conveying means, transfer means and fixing means, and a guiding portion for the recording sheet P, is formed by integral molding of a plastic material, in consideration of the cost reduction by forming a complex shape in a single component and the insulation of heat from the electric supply portion 115.

The transfer plate 123 is composed of a metal plate because a high rigidity is required for reducing the vibration generated by the rotation of the polygon mirror 105*a*.

Also the aforementioned bottom plate 124 positioned in the lowermost part of the apparatus is composed of a metal plate, in consideration of the rigidity required as a part of the structural members and the electromagnetic shielding required in supporting the electric supply portion 115.

The above-described frame configuration can achieve a low cost while satisfying the functions of heat insulation, high rigidity, heat dissipation and reduction of vibration.

Further, the configuration can be varied in various manners by changing the angle of the sheet cassette 101 and the sheet discharge tray 114 as shown in FIG. 8, according to the purpose such as reducing the footprint of the apparatus or facilitating the observation of the discharged recording sheet P. Also in such case, the effects obtained by conveying the recording sheet P in the inclined upward direction from the sheet supply means to the fixing means through the transfer means are naturally same as those in the foregoing embodiments.

In the following there will be explained, with reference to FIGS. 10 to 12, an image forming apparatus constituting a fourth embodiment of the present invention.

Figure 10:
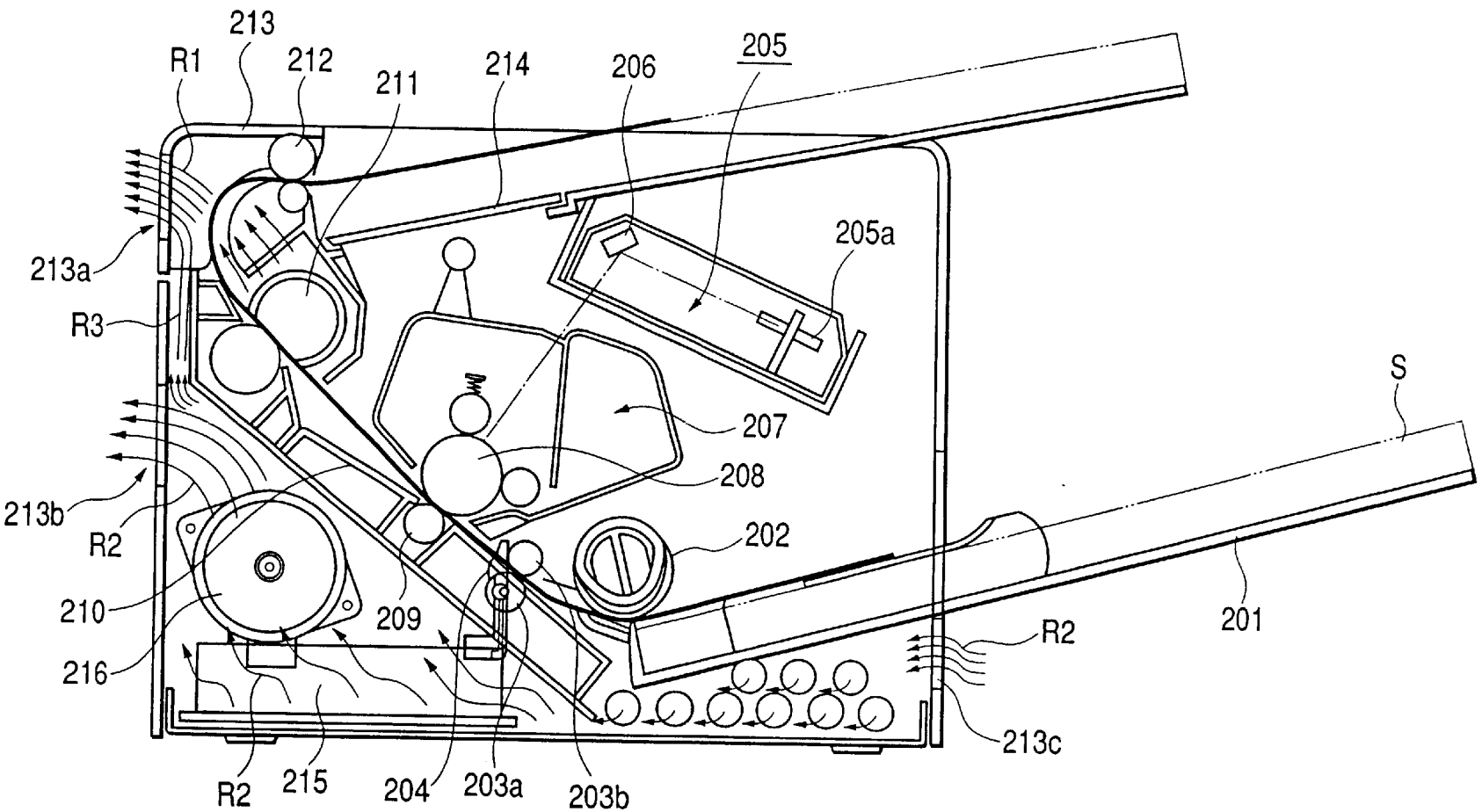
FIG. 10 is a schematic cross-sectional view of an image forming apparatus constituting a fourth embodiment of the present invention.
Figure 11:
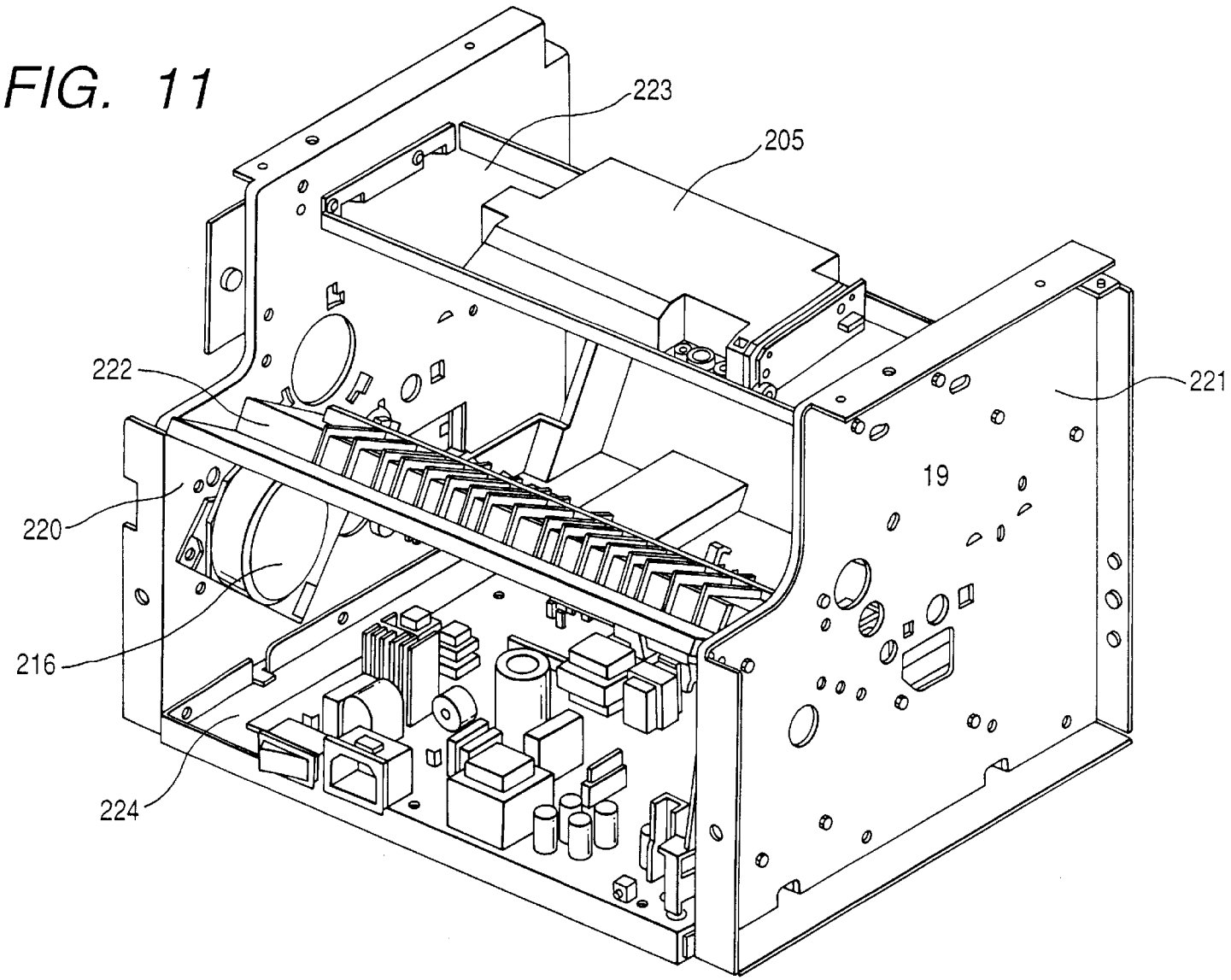
FIG. 11 is a perspective view of the image forming apparatus of the fourth embodiment, without an external cover and seen from an inclined rear direction.
Figure 12:
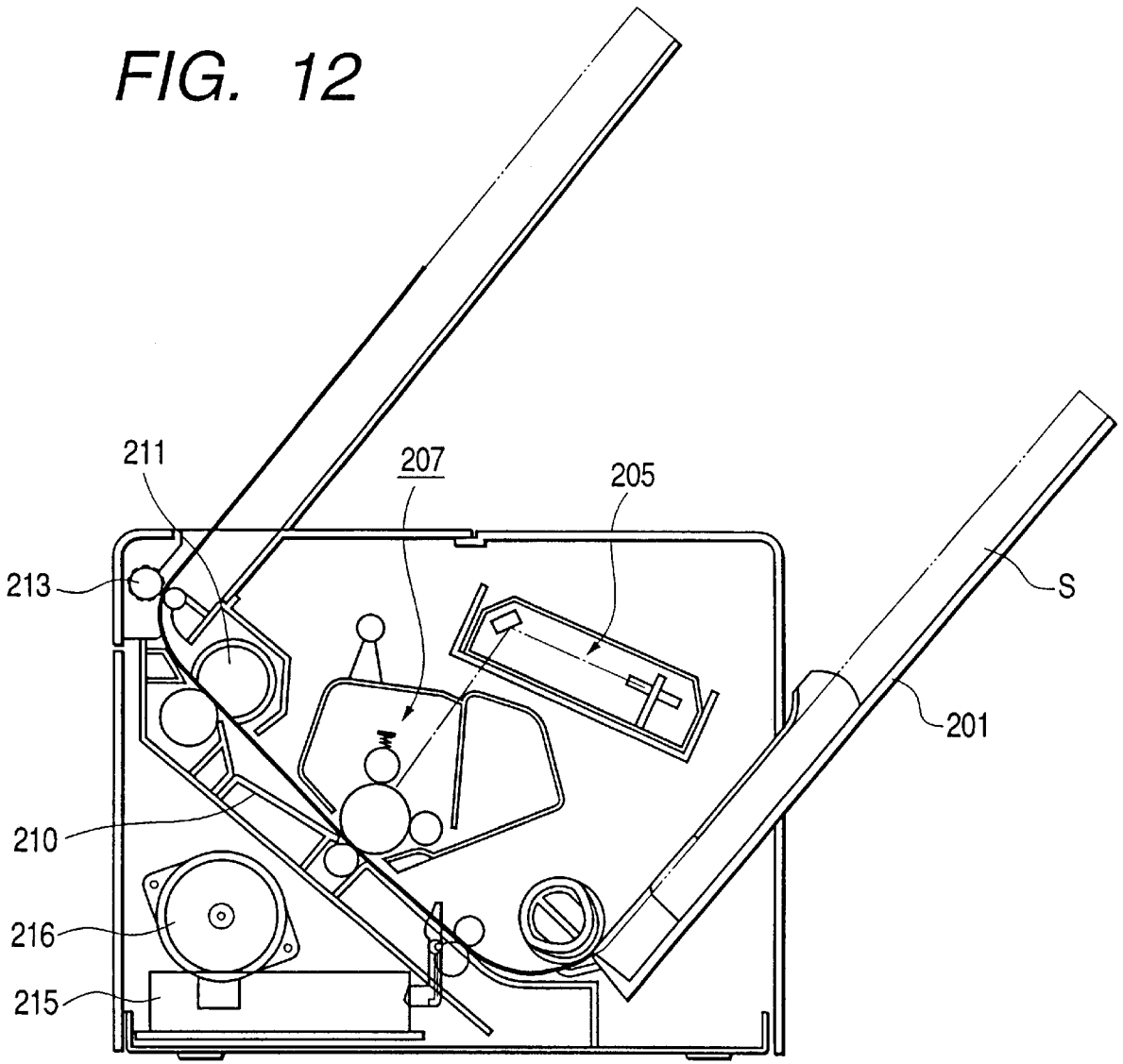
FIG. 12 is a cross-sectional view of a variation of the fourth embodiment.

FIG. 10 is a schematic cross-sectional view of the image forming apparatus of the present embodiment, while FIG. 11 is a perspective view of principal parts of the image forming apparatus of the present embodiment, and FIG. 12 is a schematic cross-sectional view showing a variation of the arrangement of the components of the image forming apparatus of the present embodiment.

The present invention is applicable not only to a copying machine or a printer but also to various image forming apparatus, but, in the following description, there will be explained, as an example, a laser beam printer employing an electrophotographic process which executes recording by scanning an image bearing member (photosensitive member) with a laser beam.

At first there will be explained the schematic configuration of the entire image formation apparatus. In the drawings, a sheet cassette 201 constituting a sheet stacking portion is detachably mounted on the image forming apparatus and contains therein stacked sheets (recording sheets) S.

The sheets S are separated and supplied one by one, by supply means (for example a supply roller) 202 provided at the upper front end of the sheet cassette 201, and the separated sheet is further conveyed to a transfer portion by conveying rollers 203*a*, 203*b* constituting conveying means.

A registration sensor 204 is provided for synchronizing the leading end position of the sheet S with the timing of light emission of a laser scanner 205 thereby starting to draw an image from a predetermined position on the sheet S.

A mirror 206 in the laser scanner 205 is provided for defining the path of the laser beam emitted from a scanning polygon mirror 205*a* provided in the laser scanner 205.

A process cartridge 207 includes members for forming an unfixed image by the known electrophotographic process, such as an image bearing member (photosensitive member) 208, a developing device, a cleaner, a charging roller etc.

Transfer means (transfer roller) 209 serves to transfer an unfixed visible image, formed on the image bearing member 208, onto the sheet S thereby forming an unfixed image thereon, and the transfer means 209 and the process cartridge 207 constitute image forming means.

A conveying guide 210 guides the sheet S after the image transfer to fixing means (fixing device) 211, which fixes the unfixed image onto the sheet S by heating.

The sheet S bearing the fixed image is discharged by discharge rollers 212 onto a sheet discharge trays 214 formed integrally with an external cover 213.

In the following there will be given a detailed explanation on the sheet conveying path.

As shown in FIG. 10, a supply portion constituted by the supply means 202, an image forming portion (in the vicinity of the contact portion of the image bearing member 208 and the transfer means 209) constituted by the image forming means and a fixing portion constituted by fixing means 211 are arranged substantially linearly in an upward inclined direction with the fixing portion at the uppermost position.

Consequently the sheet conveying path from the supply portion constituted by the supply means 202 to the fixing portion constituted by the fixing means 211 is provided substantially linearly in an inclined manner, as shown in the drawings.

The sheet S contained in the sheet cassette 201 is conveyed, after supplied by the supply means 202, to the transfer portion by the conveying roller 203 along the substantially linear conveying path, and is then further conveyed to the fixing means 211 in synchronization with the transfer of the toner image, by being pinched between the image bearing member 208 and the transfer means 209.

As the conveying path for the sheet S in these operations is substantially linear, it is rendered possible to reduce the frictional noise between the sheet S and the guide member in sheet conveying, to achieve stable conveying of the sheet S and to improve reliability thereof.

Also as the fixing means 211 is provided in the uppermost part of the sheet conveying path, the heat generated by the fixing means 211 can be discharged to the exterior of the apparatus through a louver 213*a* constituting a first discharge aperture formed in the external cover 213 even in a continuous printing operation.

Also the process cartridge 207 and the laser scanner 205, being provided in a position as high as or lower than the fixing means 211 and distant therefrom in order not to touch the air flow warmed by the heat generated by the fixing means 211, are not influenced by the heat generated from the fixing means 211 thereby constantly providing a satisfactory output image.

By arranging the fixing means 211 and the louver 213*a* in such a manner as to form a flow path (first flow path R1) from the lower part of the apparatus where the external air is introduced to the louver 213*a*, an air flow is generated in a direction indicated by an arrow in the first flow path R1, by heat generation of the fixing means 211 even without employing a fan, whereby the heat generated from the fixing means 211 can be discharged through the louver 213*a*, without detrimentally affecting other components (in particular process cartridge 207 and laser scanner 205).

It is therefore rendered possible to provide a simpler, compacter and quieter apparatus, in comparison with the conventional apparatus utilizing a fan, while preventing temperature elevation to enable high quality image formation.

Also, as in the present embodiment, various mechanisms can be positioned efficiently by providing the sheet conveying path substantially parallel to or on the diagonal of the image forming apparatus, thereby achieving compactization of the apparatus.

In the following there will be given a detailed explanation on the arrangement of the laser scanner.

As shown in FIGS. 10 and 12, the laser scanner 205 is positioned in an upward inclined manner from the polygon mirror 205*a* to the mirror 206.

In order to reduce the dimension of the image forming apparatus as far as possible, it is most effective to introduce the laser beam to the image bearing member 208 from a direction substantially perpendicular to the sheet conveying path consisting of the sheet supply means, transfer means and fixing means, as shown in FIGS. 10 and 12.

Such configuration allows to minimize the depth and the height of the image forming apparatus.

In the configuration shown in FIG. 12, the process cartridge 207 can be attached or detached substantially horizontally toward or from the sheet discharge tray 214, whereby the jam processing and the replacement of the process cartridge 107 can be executed from a same direction and the usability can be improved.

Also in the configuration shown in FIG. 10, the process cartridge 207 is attached or detached from above, but the laser scanner 205 can be distanced from the fixing device 211 and can be affected less by the heat of the fixing device 211.

The incident angle of the laser beam selected in the present embodiment provides a larger freedom in the positioning of the laser scanner 207, thereby avoiding limitation in the usability and in the temperature elevation.

In the following there will be explained the layout of the electric supply system.

An electric supply portion 215 including an AC power source, a DC power source and a high voltage source is positioned, as illustrated, in a lower part of a space formed under the sheet conveying path arranged in an inclined upward direction from the supply portion constituted by the supply means 202 to the fixing portion constituted by the fixing means 211, thereby securing a large space including the electric supply portion 215 in the area from the supply portion to the fixing portion.

Such configuration secures a path (second flow path R2) for the air flow generated by the heat from the electric supply portion 215.

By forming a louver 213*b* as a second discharge apertures in such a position in the external cover 213 as to discharge the above-mentioned air flow in an upper part of the aforementioned space, an air flow is generated in a direction indicated by an arrow in the first flow path R2, by heat generation of the electric supply portion 215 even without employing a fan, whereby the heat generated from the electric supply portion 215 can be discharged through the louver 213*b*, without detrimentally affecting other components (in particular process cartridge 207 and laser scanner 205).

It is therefore rendered possible to provide a simpler, compacter and quieter apparatus, in comparison with the conventional apparatus utilizing a fan, while preventing temperature elevation to enable high quality image formation.

In the present embodiment, a connection path R3 (formed by providing a space between the lower rear face of the fixing means 211 and the external cover 213) connecting the first path R1 and the second path R2 is provided not only for facilitating the introduction of the external air in the first path R1 but also for stimulating the air flow in the second path R2.

Thus the heat generated by the fixing means 211 positioned above the space including the electric supply portion 215 is discharged to the exterior through the louver 213*a* provided in the external cover 213 as explained above.

The air flow of high temperature generated from the fixing means 211 generates a large suction force in the path R3, thereby enhancing the air flow in the second path R2.

It is thus rendered possible to stimulate the air flow for discharging the heat generated from the electric supply portion 215 and to easily discharge the heat of the electric supply portion to the exterior of the apparatus through the louver 213*b* provided close to the connecting path R3.

As explained in the foregoing, by forming a large space under the fixing means 211, placing the electric supply portion 215 thereunder and also forming a path in the lower rear side of the fixing means 211 for connecting the area of the fixing device and the area of the electric supply portion, it is rendered possible to sufficiently generate an air flow for heat dissipation even without employing a fan for cooling or air discharge, thereby resolving heat accumulation in the image forming apparatus and preventing the temperature elevation therein.

It is thus rendered possible not only to realize a configuration not requiring the fan thereby achieving cost reduction but also to eliminate the rotation noise of such fan thereby providing a quiet image forming apparatus.

Also for effective utilization of the space under the sheet conveying path arranged in the inclined upward direction from the supply portion to the fixing portion, the electric supply portion 215 can be formed in an L-shaped layout consisting of a horizontal portion and a vertical portion, whereby the efficiency of the electric supply portion can be further improved.

More specifically, components or elements of relatively high heat generation are mounted on the vertical plane side of the apparatus while those of relative low heat generation are provided on the horizontal plane side, whereby the heat discharge from the electric supply portion can be executed more efficiently.

In the following there will be explained the arrangement of the drive source.

A motor 216 constituting the drive source is directly mounted, as shown in FIG. 11, on a conductive left side wall 220 constituting a part of the frame of the apparatus, and is positioned under the sheet conveying path.

The above-mentioned positioning of the motor 216 under the sheet conveying path allows to flexibly adapt to a change to a larger motor or a change from a stepping motor to a DC motor in order to achieve a higher process speed in the image forming apparatus.

It is therefore possible to easily achieve a higher speed for example from 10 ppm to 20 ppm.

Also the direct mounting of the motor 216 on the conductive frame of the apparatus allows to dissipate the heat generated by the motor 216 easily to the frame thereby improving the efficiency of the motor and facilitating grounding of the motor, thereby reducing the cost of the apparatus in total.

Furthermore, by positioning the motor 216 in the electric supply area under the sheet conveying portion, the heat generated from the motor 216 also stimulates the air flow generated in the second path R2 by heat from the electric supply portion 215 whereby the heat of the motor 216 and the electric supply portion 215 can be discharged more efficiently.

In the following there will be explained the configuration of the frame.

The frame of the laser beam printer of the present embodiment is composed, as shown in FIG. 11, of a pair of conductive side plates 220, 211, a resinous conveying plate 222 supporting the supply means, conveying means (conveying rollers 203*a*, 203*b*), transfer means 209 and fixing means 211, a conductive scanner plate 223 supporting the laser scanner 205 and a conductive bottom plate 224 supporting the electric supply portion 215 and provided in the lowermost part of the apparatus.

The above-mentioned conductive left and right plates 220, 221 are desirably composed of a conductive material in consideration of rigidity, ease of electrical grounding and electromagnetic shielding, and, in the present embodiment, they are composed of metal plates. As explained in the foregoing, the motor 216 is directly mounted on the left side plate 220 and such material provides significant advantages in facilitating the heat dissipation, reduction of vibration and electrical grounding.

The conveying plate 222, including a portion for supporting the principal units such as the supply means 202, conveying means, transfer means 209 and fixing means 211, and a guiding portion for the sheet S, is formed by integral molding of a plastic material, in consideration of the cost reduction by forming a complex shape in a single component and the insulation of heat from the electric supply portion 215.

The scanner plate 223 is composed of a metal plate because a high rigidity is required for reducing the vibration generated by the rotation of the polygon mirror 205*a*.

Also the bottom plate 224 provided in the lowermost part of the apparatus is composed of a metal plate in consideration of the requirements for the rigidity as a part of the structural members and for the electromagnetic shielding for supporting the electric supply portion.

The above-described frame configuration provides an effect of achieving a low cost while satisfying the functions of heat insulation, high rigidity, heat dissipation and reduction of vibration.

Also there can be adopted various configurations by changing the angle of the sheet cassette (or supply tray) and the sheet discharge tray, according to the purpose such as easier visibility of the discharged sheets.

Also in such case, there can naturally be attained the aforementioned effects such as prevention of temperature elevation.

In the following there will be given a detailed description on the air flow.

As explained in the foregoing, the air flow in the image forming apparatus of the present embodiment is principally divided into two systems.

The first one is a strong air flow for discharging the heat generated from the fixing means 211.

The second one is a relatively weak air flow for discharging the heat generated from the electric supply portion 215.

In order to stimulate the weak air flow, the area of the electric supply portion is made large while a discharge aperture is provided in the uppermost part of the area of the electric supply portion, thereby enhancing the convection in the electric supply portion and improving the efficiency of air discharge.

Also by forming a path connecting the area of the fixing portion and that of the electric supply portion behind the fixing device, the strong the flow therefrom enhances the weak air flow of the electric supply portion, thereby stimulating such weak air flow and improving the efficiency of air discharge in the electric supply portion.

In the present embodiment, the discharge aperture is provided only on the rear face of the main body of the image forming apparatus.

The air discharged from the fixing device or the electric supply portion is of a relative high temperature and is rather unpleasant, so that the feeling of the user in operation can be improved by positioning the discharge aperture only in the rear face of the image forming apparatus, farthest from the operation side of the apparatus.

The above-described configuration allows to prevent unnecessary temperature elevation of the image forming portion or the electric supply portion even without a fan, thereby avoiding drawbacks such as a defective image or a failure of the apparatus.

Also such fanless configuration allows to attain a quieter and less expensive image forming apparatus.

What is claimed is:

1. An image forming apparatus comprising:

sheet supply means;

image forming means for forming an image on a sheet supplied by said sheet supply means;

fixing means for fixing the image formed on the sheet;

a sheet guide for guiding the movement of the sheet; and a control board bearing an element for controlling said image forming means, wherein said sheet guide positioned between said sheet supply means and said fixing means is provided substantially linearly in such a manner that the sheet moves in an inclined upward direction, and said control board is provided in a space having a substantially triangular-shaped cross-section defined by said sheet guide and a bottom face of the apparatus.

2. An image forming apparatus according to claim 1, wherein the angle of said sheet with respect to the bottom face of the apparatus is within a range from 30° to 60°.

3. An image forming apparatus according to claim 1, wherein said sheet guide supports transfer means for transferring the image onto the sheet, and said fixing means.

4. An image forming apparatus according to claim 1, wherein said sheet guide is positioned substantially parallel to a diagonal crossing the interior of the apparatus.

5. An image forming apparatus according to claim 1, wherein said sheet guide is formed with a heat insulating synthetic resin material.

6. An image forming apparatus according to claim 1, further comprising an aperture for discharging the heat generated in the apparatus to the exterior, wherein said aperture is provided in the vicinity of said fixing means.

7. An image forming apparatus according to claim 6, wherein said aperture includes a first aperture provided above said fixing means and a second aperture provided in the vicinity of the uppermost part of a space under said sheet guide, and said apparatus further comprises an air path connecting said first aperture and said second aperture.

8. An image forming apparatus according to claim 1, further comprising, at the lower part thereof, a suction aperture for sucking the external air into the space under said sheet guide.

9. An image forming apparatus according to claim 8, further comprising a cassette mounting portion for mounting a sheet supply cassette, wherein said suction aperture is provided under said cassette mounting portion.

10. An image forming apparatus according to claim 1, wherein said sheet guide is composed of a material same as that of an external casing of the apparatus.

11. An image forming apparatus according to claim 1, wherein said sheet guide is composed of a recycled material.

12. An image forming apparatus comprising:

sheet supply means;

image forming means for forming an image on a sheet supplied by said sheet supply means;

fixing means far fixing the image formed on the sheet;

a sheet guide for guiding the movement of the sheet: and a drive source for driving said sheet supply means and said fixing means, wherein said sheet guide positioned between said sheet supply means and said fixing means is provided substantially linearly in such a manner that the sheet moves in an inclined upward direction, and said drive source is provided in a space having a substantially triangular-shaped cross-section defined by said sheet guide and a bottom face of the apparatus.

13. An image forming apparatus according to claim 12, wherein the frame of said apparatus is composed of a conductive material and said drive source is mounted on said frame.

14. An image forming apparatus according to claim 12, further comprising a control board bearing an element for controlling said image forming means, said control board being provided in the space.

15. An image forming apparatus comprising:

sheet supporting means for supporting sheets;

sheet supply means for supplying the sheet from said sheet supporting means;

image forming means for forming an image on the sheet; and fixing means for fixing the image formed on tile sheet, wherein a sheet conveying path from said sheet supply means to said fixing means is substantially linear in such a manner that the sheet moves in an inclined upward direction and substantially parallel to a diagonal of a frame supporting said sheet conveying path.

16. An image forming apparatus according to claim 15, wherein said frame is formed by metal plate working.

17. An image forming apparatus according to claim 15, further comprising an external cover of a plastic material, covering said frame.

18. An image forming apparatus according to claim 15, further comprising an electric power supply board and a drive motor, which are provided in a space under said sheet conveying path.

19. An image forming apparatus according to claim 18, wherein said drive motor is mounted in said frame standing perpendicularly to an installing plane of the apparatus.

20. An image forming apparatus comprising:

a base frame including two side plates provided perpendicularly to an installing plane of the apparatus, a plate-shaped first stay mounted on said two side plates and positioned at the bottom side of said side plates, a plate-shaped second stay mounted on said two side plates and positioned at the upper side of said side plates, and a plate-shaped third stay mounted on said two side plates and positioned between said first and second stays;

wherein said first, second and third stays are provided substantially in Z-shape between said two side plates.

21. An image forming apparatus according to claim 20, wherein said two side plates and said first and second stays are composed of a metal, while said third stay is composed of a resinous material.

22. An image forming apparatus according to claim 20, further comprising a photosensitive member, a scanner for scanning said photosensitive member with light corresponding to an image signal, a sheet guide for guiding the movement of a sheet, and a power source portion, wherein said scanner is supported by said second stay, said sheet guide is supported by said third stay and said power supply portion is supported by said first stay.

23. An image forming apparatus according to claim 22, wherein said sheet guide and said third stay are integrally formed.

24. An image forming apparatus according to claim 22, further comprising an engine controller for controlling the drive of the apparatus, said engine controller being supported by said first stay.

25. An image forming apparatus according to claim 22, wherein said photosensitive member is attachable to or detachable from the apparatus through an aperture provided between said second and third stays.

26. An image forming apparatus according to claim 20, wherein said first, second and third stays are provided substantially in Z-shape between said two side plates so that a sheet on which an image is to be formed is moved along said third stay in an inclined upward direction.

* * * * *

UNITED STATES PATENT AND TRADEMARK OFFICE

CERTIFICATE OF CORRECTION

PATENT NO. : 6,415,118 B1
DATED : July 2, 2002
INVENTOR(S) : Takeshi Setoriyama et al.

It is certified that error appears in the above-identified patent and that said Letters Patent is hereby corrected as shown below:

Column 7,
Line 39, “provided” should read -- provide --.

Column 10,
Line 42, “becomes” should read -- become --.

Column 11,
Line 38, “form” should read -- from --.

Column 12,
Line 58, “thereby” should read -- and are thereby --.

Column 16,
Line 22, “after” should read -- after being --.

Column 17,
Line 41, “apertures” should read -- aperture --.

Column 19,
Line 59, “strong the flow” should read -- strong air flow --.

Column 21,
Line 1, “far” should read -- for --.

Signed and Sealed this

Fifteenth Day of April, 2003

JAMES E. ROGAN
*Director of the United States Patent and Trademark Office*